US006349975B1

(12) United States Patent
Heil

(10) Patent No.: US 6,349,975 B1
(45) Date of Patent: Feb. 26, 2002

(54) SLAB PLUMBING SYSTEM

(76) Inventor: Deryl Heil, 16832 3330th St., Onamia, MN (US) 56359-2833

( * ) Notice: Subject to any disclaimer, the term of this patent is extended or adjusted under 35 U.S.C. 154(b) by 0 days.

(21) Appl. No.: 09/631,159

(22) Filed: Aug. 3, 2000

Related U.S. Application Data

(62) Division of application No. 09/154,906, filed on Jul. 17, 1998, now Pat. No. 6,101,774.

(51) Int. Cl.[7] ..... F16L 3/00
(52) U.S. Cl. ..... 285/64; 285/58
(58) Field of Search ..... 285/58, 64, 148.27, 285/56; 52/220.8, 232, 302.1

(56) References Cited

U.S. PATENT DOCUMENTS

| | | | | |
|---|---|---|---|---|
| 2,121,984 A | * | 6/1938 | Rieger | 285/33 |
| 2,202,147 A | | 5/1940 | Gerriets | 52/220.8 |
| 2,212,974 A | * | 8/1940 | Bateman | 25/128 |
| 2,807,479 A | | 9/1957 | Hixon | 285/64 |
| 3,048,911 A | * | 8/1962 | Almon | 25/118 |
| 4,261,598 A | | 4/1981 | Cornwall | 285/56 |
| 4,313,286 A | * | 2/1982 | Harbeke | 52/220 |
| 4,453,354 A | | 6/1984 | Harbeke | 52/220 |
| 4,490,954 A | | 1/1985 | Cresti | 52/221 |
| 4,587,082 A | * | 5/1986 | Schoening | 376/291 |
| 4,619,087 A | | 10/1986 | Harbeke | 52/221 |
| 4,619,471 A | | 10/1986 | Harbeke | 285/158 |
| 4,623,170 A | | 11/1986 | Cornwall | 285/4 |
| 4,823,527 A | | 4/1989 | Harbeke | 52/221 |
| 4,882,886 A | | 11/1989 | Harbeke | 52/232 |
| 4,953,235 A | | 9/1990 | Corwall | 285/64 |
| 4,982,538 A | | 1/1991 | Horstketter | 52/259 |
| 5,035,097 A | | 7/1991 | Cornwall | 52/220 |
| 5,218,795 A | | 6/1993 | Horstketter | 52/125.5 |
| 5,309,688 A | | 5/1994 | Robertson | 52/220.8 |
| 5,451,081 A | | 9/1995 | Kaucnik | 285/56 |
| 5,787,672 A | | 8/1998 | Giannuzzi et al. | 52/698 |
| 5,806,829 A | | 9/1998 | Banks | 249/11 |
| 5,806,830 A | | 9/1998 | Alvarez | 251/145 |

FOREIGN PATENT DOCUMENTS

| | | |
|---|---|---|
| JP | 405033503 | 2/1993 |

* cited by examiner

*Primary Examiner*—Gary Estremsky
(74) *Attorney, Agent, or Firm*—Guy McClung

(57) ABSTRACT

A plumbing system, a slab therewith and a bowl for a plumbing system have been invented, the bowl, in one aspect having an outer side wall, the outer side wall being generally cylindrical in shape with a hollow interior and having a height and a top opening, an inner wall, the inner wall being generally cylindrical and having a hollow interior, the inner wall having a top opening and a bottom opening and a height equal to or less than the height of the outer side wall, a bottom wall comprising a generally circular ring, the bottom wall having an outer edge contacting a lower edge of the outer side wall and an inner edge contacting a lower edge of the inner wall, the bottom wall spacing apart the outer side wall from the inner wall around a circumference of the bowl, wherein the bottom opening of the inner wall is sized for receiving a pipe member, a coupling member positioned with a portion thereof within the bottom opening of the inner wall of the bowl, and a cap over the bowl. Following pouring of the slab, a top of the cap or the cap is removed and a pipe is inserted into a lower opening of the bowl to provide a pipe passageway through the slab. In one aspect the pipe is angled and is rotated within the bowl to locate an upper end of the pipe at a desired orientation with respect to the bowl. Methods have also been invented for using such bowls and systems.

19 Claims, 3 Drawing Sheets

SLAB PLUMBING SYSTEM

RELATED APPLICATION

This is a division of U.S. application Ser. No. 09/154,906 filed Sep. 17, 1998, U.S. Pat. No. 6,101,774, issued Aug. 15, 2000.

BACKGROUND OF THE INVENTION

1. Field Of The Invention

The present invention is directed to plumbing systems and to such systems with a concrete slab.

2. Description of Related Art

The prior art discloses a wide variety of plumbing systems in combination with concrete slabs. Typically a plumbing pipe system is put in place within a predetermined area for a concrete slab. In various systems, several pipes project upwardly past what will be the top surface of the slab. In many instances, it is difficult, if not impossible, to adequately trowel and smooth the concrete around the pipes. Often the pipes are close to the location of walls, commodes, and other structural members that require a substantially flat top slab surface. Often a projecting part of a pipe is moved during a pour and, following setting of the concrete, is not at a desired location. This may require jackhammering of the concrete around the pipe so it can be moved back to the proper location.

The prior art discloses various plumbing fixtures, pipe couplers, and slab/plumbing systems. U.S. Pat. No. 4,261,598 discloses a pipe coupling to be embedded in a concrete floor and to form part of a fluid flow path with the pipe that has a tube, preferably integrally molded of plastic, with an inside annular rim coupling with parallel shoulders perpendicular to a longitudinal cylindrical axis of the tube, with an annular face parallel to the axis between the shoulders, an attachment means, preferably an annular flange with tabs for nails or the like, at one end of the tube to be secured to a form such as a wooded form for pouring the concrete floor around the pipe and coupling and a removable cover at the end of the tube adjacent the attachment means and adapted to prevent poured cement from entering the inside of the tube. The coupling is mounted on a form and the concrete flooring is poured around it. The coupling is adapted for supporting a toilet bowl mounting flange in residential and commercial construction and for mounting plastic piping between multiple levels of concrete floors usually in commercial construction.

U.S. Pat. No. 4,453,354 discloses a device to be permanently embedded in the masonry floor of a building structure for both supporting and joining pipe sections extending above and below the floor. The device has an anchor surrounded by the masonry material to prevent movement relative to the floor. The ends of the device are of several different designs to permit the joining thereto of pipe ends by various methods.

U.S. Pat. No. 4,490,954 discloses a masking cover for a wall surface around a pipe, the cover with two circular concentric plates each provided with a radial slot with parallel edges connected together by a semicircular portion having its center coinciding with that of the plates, the plates arranged for mounting by way of their slot around the pipe in order to form a single stable facing in the form of a circular masking cover.

U.S. Pat. No. 4,619,087 discloses a support apparatus and method for attaching fluid-conveying pipe couplings of various lengths to be embedded in concrete barriers of various thicknesses to a metal concrete form involve a dual diameter outer disk attached to an elongated compressing column which extends through a hole in the concrete form to a fastening means in order to compress the fluid conveying pipe couplings in the fixed positions between the form and the outer disk. The fastening means can be attached to the compressing column at any longitudinal positions. An inner disk can also be put between the form wall and an inner end of the pipe coupling to provide extra rigidity. The disks act as forms to produce openings in the concrete barriers at opposite ends of the pipe couplings. Nothing extends beyond an outer, perimeter, surface of a forming portion of the outer disk. A preferred coupling assembly with which the support apparatus is used, and a method of using the same, involves a male/male, relatively short, insert having an O-ring seal and a tapered internal surface at only one end to form a sliding seal with a female/female pipe coupling portion embedded in the concrete barrier. A hand grip is formed on the outside surface of the insert.

U.S. Pat. No. 4,619,471 discloses a pipe coupling holder for holding a pipe coupling joint to be embedded in concrete and has a cylindrically-shaped barrel member having an inner wall to which the coupling joint is attached at a first end. The holder also includes a flange member, which is separate from the barrel member, but which has a hole of the size for snugly receiving a fixed-shaped outer wall of the barrel member to be selectively slidable along the barrel member and attachable thereto at any selected position. A second end portion of the barrel member can be cut away to accommodate a raised portion of a concrete form wall and the flange member can be slid along the outer surface of the barrel member to the top of the raised portion. The separate flange member is then adhered in this position to the outer wall of the barrel and fastened to the raised portion of the concrete form wall to hold a pipe coupling in a fixed position during the pouring of concrete in the form.

U.S. Pat. No. 4,623,170 discloses a coupling to be embedded in concrete which has multiple concentric rings on an outside wall of a tube which aid in preventing leakage along the outside wall and which help in providing fire retardancy. The coupling includes a step form having a regular diameter which aids in positioning the coupling using a template.

U.S. Pat. No. 4,823,527 discloses a plumbing concrete form accessory with a relatively large hollow displacement member having a hole in a wall thereof and defining a sleeve about the hole for snugly fitting the outside surface of a pipe. A dissolving type adhesive is used to adhere the sleeve adjacent a first end of the pipe and a second end of the pipe is mounted to a concrete form by means of a slidable flange which is also adhered to the outside surface of the pipe. A spacer cuff is mounted snugly about the outside surface of the pipe adjacent the second end thereof. The mounted pipe supports the hollow displacement member in the concrete form while concrete is poured about the pipe and the displacement member. In a preferred embodiment, a cover is used to cover an open side of the displacement member to allow selective access to the interior of the displacement member for coupling a fixture to the first end of the pipe once the concrete has hardened.

U.S. Pat. No. 4,882,886 discloses a pipe attachment device for attaching a pipe to a concrete form wall which includes an axially extending wall and a floor extending laterally from a first end of the axially extending wall. The floor is affixed to the concrete form and the pipe to be held in place on the form is pressed on the axially extending wall. The pipe is held thereon by the friction of a force fit. After concrete is poured into the form wall and allowed to cure, the pipe attachment device is removed with the concrete form wall while the pipe is allowed to stay embedded in the wall. A separate riser is adhered to the outer surface of a standard pipe to prevent it from sliding out of the concrete once the form is removed. A special pipe coupler can be used with a male pipe attachment device having a built in shoulder and riser. Intumescent cuffs can be used with either the standard pipe or the special pipe coupler.

U.S. Pat. No. 5,035,097 discloses a coupling adapted to be pressed into or secured in a hole in a concrete floor or wall which is secured in place by a concrete to plastic adhesive and can serve as part of the piping system of a building.

U.S. Pat. No. 5,309,688 discloses a penetration unit for a concrete slab including a hollow housing open at one end for receiving a service line or pipe, and provided at its other end with an enlarged opening surrounded by an annular flange which enables connection of the housing to formwork defining the boundary of the concrete slab. The housing defines a hollow space in which the service line or pipe terminates and may be connected to a further line or pipe such as an elbow. A puddle flange may be located about the service line or pipe and engage the housing. Intumescent material may be located in the hollow space surrounding the pipe or line.

There has long been a need for: an efficient effective system and method for: locating and installing pipes for a plumbing system in an area in which a concrete slab is to be poured; for such a system and method in which pipes do not need to be relocated following setting of the slab; for such a system that does not obstruct the placement, levelling, and finishing of a poured concrete slab; for such a system which allows adjustment of pipe location after a slab has hardened without damage to the slab; and for such a system that increases slab quality around projected plumbing pipe locations while reducing the labor cost of the finishing process and of making pipe location adjustments after a slab has hardened.

SUMMARY OF THE PRESENT INVENTION

The present invention, in certain embodiments, provides a pipe system for a concrete slab, the system including a bowl with an inner annular space defined between an inner surface of a circular outer wall, an outer surface of an inner wall, and a bottom wall that interconnects and spaces apart the inner wall and the outer wall. The inner surface of the inner wall defines a circular opening through the bowl that is sized to snugly receive a pipe end or a coupling on a pipe end, e.g. a pipe that will extend below the slab to be formed.

In one aspect the pipe projects upwardly to such an extent and the bowl is sized and configured so that in position on the pipe end prior to the pouring of concrete for the slab, the top edge of the bowl's outer wall does not prospect upwardly higher than the planned eventual top flat surface of the slab. A cap which fits snugly around the bowl's outer wall covers the bowl and prevents concrete and debris from entering the bowl. The bowl's top edge may be positioned at any desired level, either below the level of the top of the slab or at the same level. The cap on the bowl, whatever the level of the bowl's top edge, may coincide with the top level of the slab.

In one aspect the cap's cover is made of material (e.g. but not limited to plastic, paper, cardboard, or fiberglass) which is easily punctured and/or removed from the cap so that a pipe or pipe extension can be introduced into and secured within the bowl's circular opening. In one aspect the bowl's inner wall and outer wall are co-incident. In one embodiment, as discussed above, the inner wall and the outer wall are spaced-apart. In one aspect of such an embodiment the inner wall is shorter than the outer wall so that, to the extent that the two walls are spaced apart, a pipe section with a bend in it may have one end emplaced in the bowl's opening and, prior to securement therein, the pipe section is rotatable so that the projecting portion and end are selectively positionable. Such an adjustment feature is very beneficial in those instances in which the bowl opening is partially blocked. Once the pipe section is placed in or rotated to a desired position, it is fixed in place (e.g. with welding or glue).

In one aspect, following removal of the top of the cap after a slab has set therearound, a toilet flange's lower end is emplaced in the bowl. Alternatively, a pipe extension is attached to the pipe from below the slab on which the bowl is mounted and the toilet flange's lower end is introduced into the bowl and disposed around a top end of the pipe extension.

A system as described above can also be used for connection the drain of a tub.

What follows are some of, but not all, the objects of this invention. Other objects and purposes will be readily apparent to one of skill in this art who has the benefit of this invention's teachings and disclosures.

It is, therefore, an object of at least certain preferred embodiments of the present invention to provide:

- New, useful, unique, efficient, nonobvious slab/plumbing systems;
- Such systems and methods in which adequate and effective concrete treatment adjacent an opening for a pipe can be accomplished; and
- Such systems and methods which permit adjustment of pipe positioning following setting of a slab, in one aspect without the need to forcibly remove concrete.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
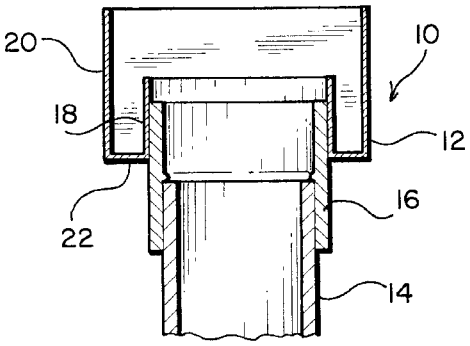
FIG. 1A is a side view in cross-section of a plumbing system according to the present invention.

FIG. 1A shows a system 10 according to the present invention which has a bowl 12 connected to a typical plumbing system pipe 14 (e.g. but not limited to a sewer pipe) with a coupling 16; such members connected by a friction fit, by welding (for metal pipe), by PVC cement (for PVC pipe), and/or by any suitable adhesive or securement method. An inner wall 18 of the bowl 12 is spaced apart from an outer wall 20 by a bottom wall 22.

Figure 1B:
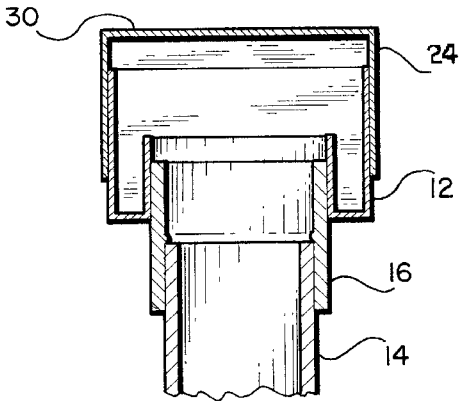
FIG. 1B is a side view in cross-section that shows a cap according to the present invention with the system of FIG. 1A.

FIG. 1B shows the system 10 with a cap 24. The members 12, 14, 16, and 24 are generally cylindrical with hollow bodies and central bores. The cap 24 is secured over the bowl 12 and, in certain preferred embodiments, is placed at a precise level on or above the body 12.

Figure 1C:
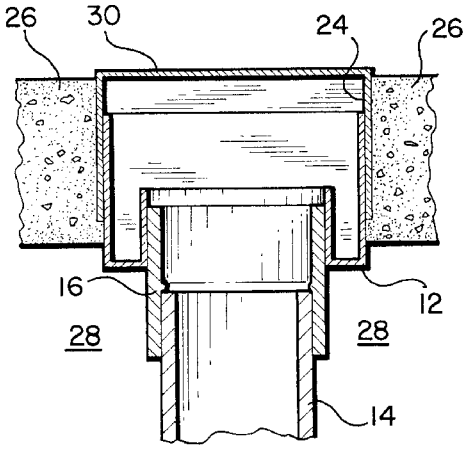
FIG. 1C is a side view in cross-section that shows a concrete slab poured around the system of FIG. 1A.

As shown in FIG. 1C, concrete 26 resting on earth 28 has been poured around the bowl 12. The pipe 14 in one aspect represents a connection to a sewer line (not shown). The concrete 26 has been poured to the level of a top 30 of the cap 24.

Figure 1D:
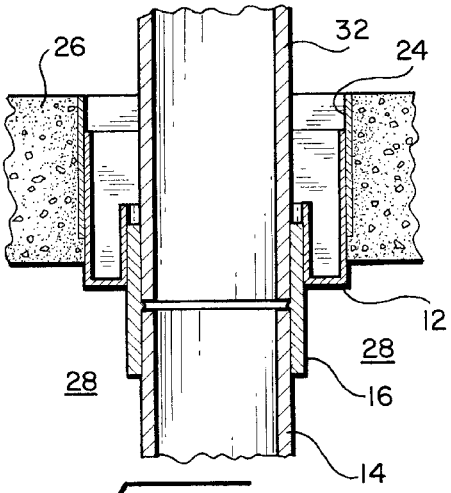
FIG. 1D is a side view in cross-section that shows the cap of FIG. 1A removed and a pipe installed with the system of FIG. 1A.

As shown in FIG. 1D, the top 30 of the cap 24 has been removed, permitting access to the interior of the bowl 12. Prior to removal of the top 30, the cap 24 prevented debris, concrete, etc., from entering the bowl and the pipe 14. After removal of the top 30, a pipe 32 is introduced into the bowl 12 and secured in place in fluid communication with the pipe 14. If the pipe 14 was correctly positioned prior to pouring the concrete 26, then the pipe 32 is correctly positioned following its securement to the pipe 14.

Figure 1E:
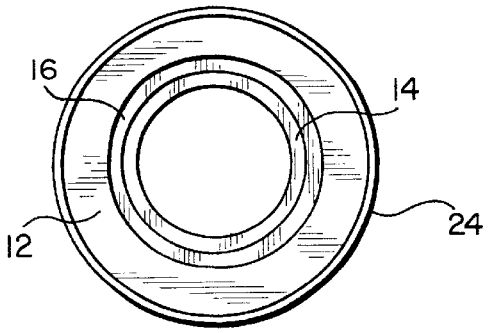
FIG. 1E is a top view of the system of FIG. 1D.
Figure 1F:
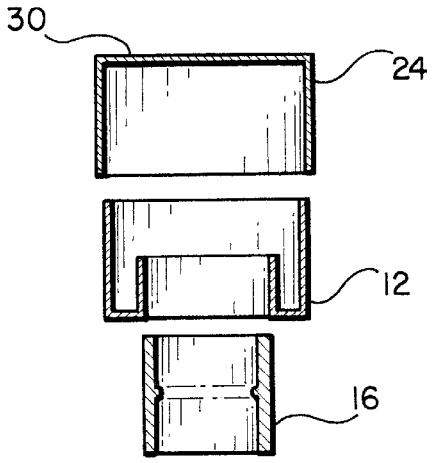
FIG. 1F is a side view in cross-section of parts of the system of FIG. 1A.
Figure 1G:
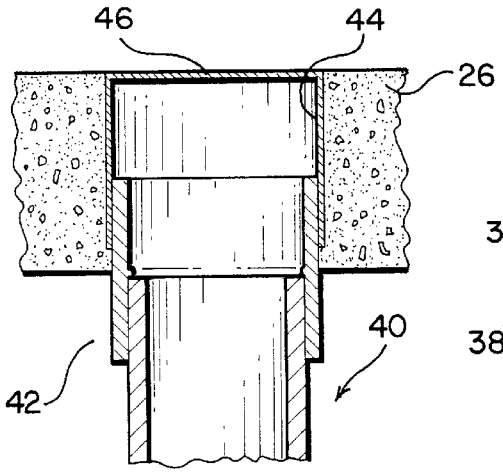
FIG. 1G is a side view in cross-section of a plumbing system according to the present invention.
Figure 1I:
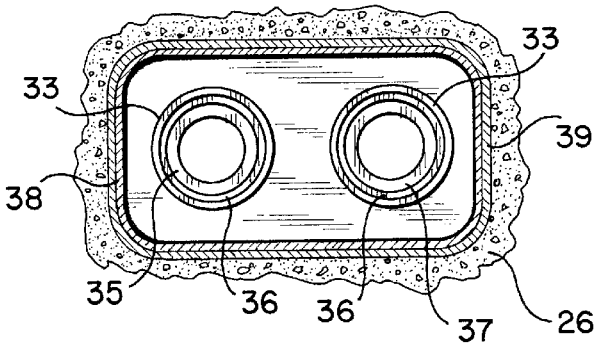
FIG. 1I is a view along line 1I—1I of FIG. 1H.
Figure 1H:
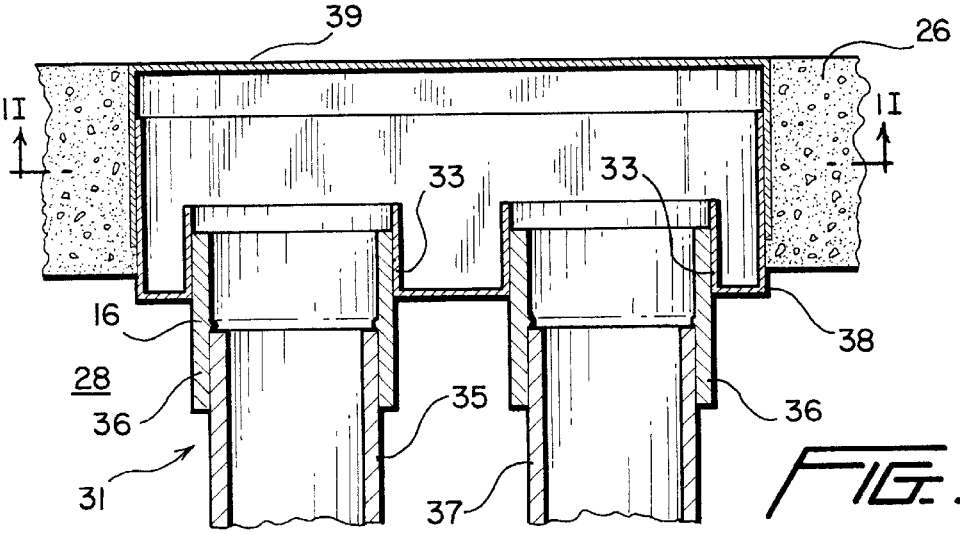
FIG. 1H is a side view in cross-section of a plumbing system according to the present invention.

FIG. 1G shows an alternative system 40 in which, instead of the bowl 12, a coupling 42 is used with a cap 44 having a movable or breakable top 46. FIG. 1H shows a system 31 like that of FIG. 1A, but with a bowl 38 with multiple lower openings 33 accommodating multiple sewer pipes 35, 37. A cap 39 covers the bowl 38 and couplings 36 are used in the openings 33. It is within the scope of this invention to have a system to accommodate any desired number of pipes.

Figure 2A:
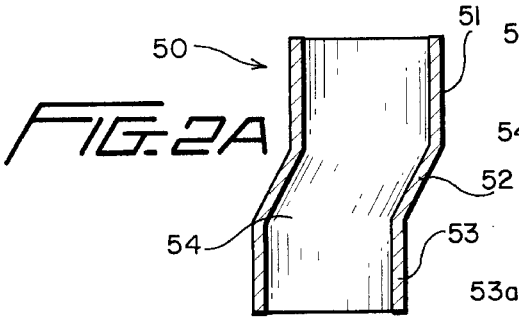
FIG. 2A is a side cross-section view of a pipe according to the present invention.

FIG. 2A shows a pipe 50 according to the present invention that has a top member 51, a central member 52 at an angle to the top member 51, and a bottom member 53 at an angle to the central member 52. A fluid flow bore 54 extends through the pipe 50.

Figure 3:
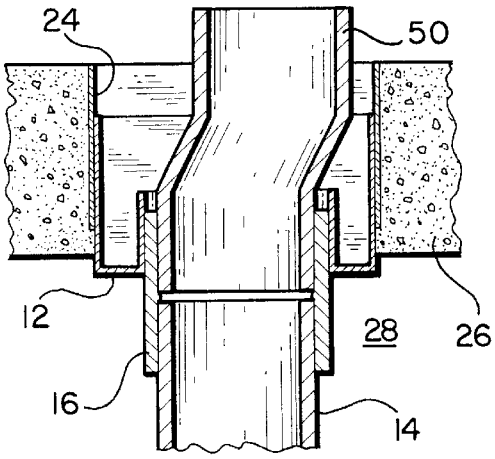
FIG. 3 is a side view in cross-section of a plumbing system according to the present invention.
Figure 4:
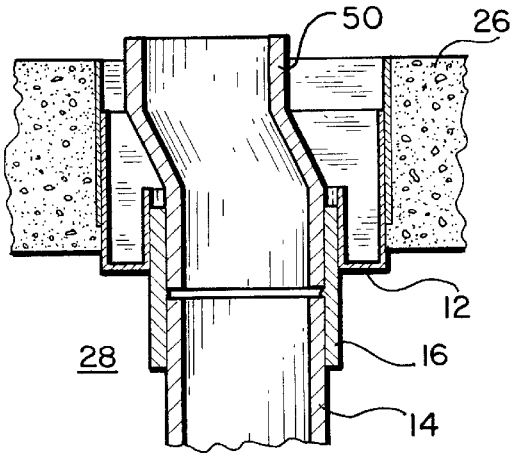
FIG. 4 is a side view in cross-section of a plumbing system according to the present invention.

FIG. 3 shows the pipe 50 used in system 10 (as in FIG. 1D) but without the pipe 32. The pipe 50 is rotatable in the coupling 16 prior to final securement therein. Thus the pipe 50 may exit from the bowl 12 and rise above the concrete 26 at a variety of positions. The pipe 50 can be rotated through 360 degrees and the top member 51 is at such an angle that it does not abut the interior of the side wall of the cap 24 or of the bowl 12. FIG. 4 shows another orientation for the pipe 50.

Figure 2B:
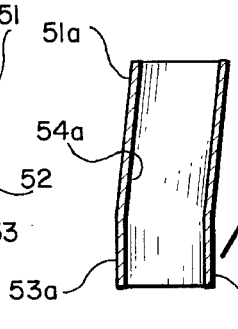
FIG. 2B is a side cross-section view of a pipe according to the present invention.

By appropriately sizing a pipe 50*a* with a top member 51*a* and a bottom member 53*a,* as in FIG. 2B, the central member 52 may be deleted and the benefits of rotatability of the pipe in the coupling 16 (or in the bowl 12 if the coupling is omitted) may be achieved with the pipe 50*a.* A bore 54*a* extends through the pipe 50*a.* Alternatively the pipe 50 (the pipe 50*a,* and any other pipe disclosed herein performing the same functions) may have a height such that it does not project upwardly beyond the lower surface of the cap and, in one aspect, such a pipe (or pies) is included with the system (e.g. the systems of FIGS. 1A, 1H, 3 and 6A). It is also within the scope of this invention for the inner and outer bowl walls to be the same height.

The rotatability of the pipe 50 (or 50*a* and pipes in other embodiments disclosed herein) makes it possible for a builder to offset the part of the pipe emerging from a slab from the pipe that extends below and away from the slab to which the emerging pipe is to be secured. This ability of thus offset a pipe, even following setting of the concrete can be very helpful in final plumbing fixture installation and/or pipe routing. A bowl according to the present invention and a corresponding cap and pipe with at least one angled portion can be any desired size to provide any desired amount of offset.

Figure 5A:
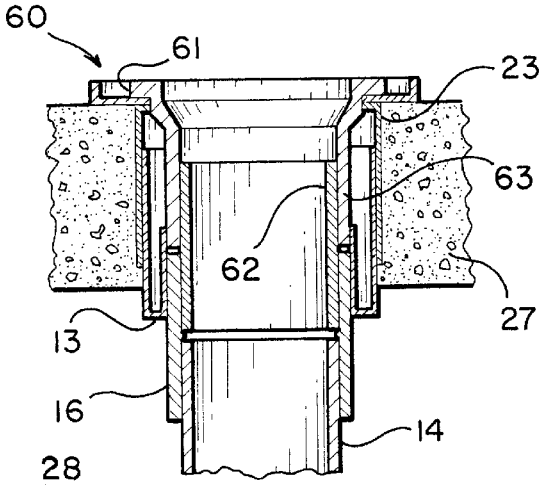
FIG. 5A is a side view in cross-section of a plumbing system according to the present invention.
Figure 5B:
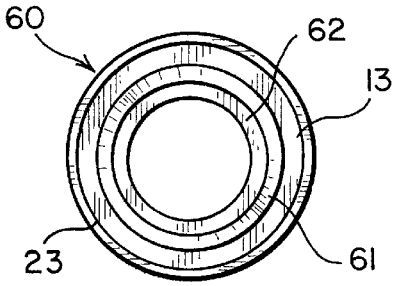
FIG. 5B is a top view of the system of FIG. 5A.

FIGS. 5A and 5B show a system 60 like the system 10, but with a bowl 13 and a top pipe piece 62 for accommodating a toilet flange 61 instead of another pipe (like the pipes 32 and 50). Since parts of the system 60 do not project above the level of hardened concrete 27, trowelling and smoothing of the surface 29 prior to setting of the concrete 27 is possible, thus producing a very level surface 29 on which the toilet flange 61 sits flat with minimal or no movement or "wobbling." A cap 23 initially covers the bowl 13, but its top (not shown) is removed to permit introduction of a lower end 63 of the flange 61 into the bowl 13. The pipe piece 62 is optional, but it can help secure the toilet flange 61.

Figure 6B:
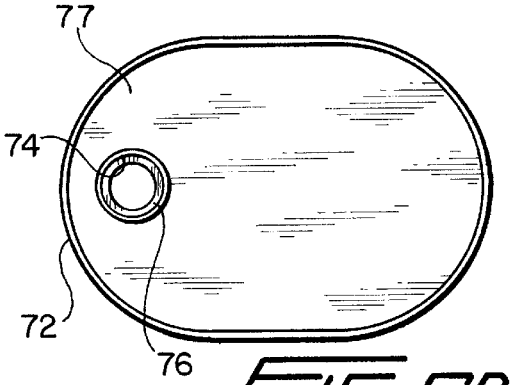
FIG. 6B is a top view of the system of FIG. 6A.
Figure 6A:
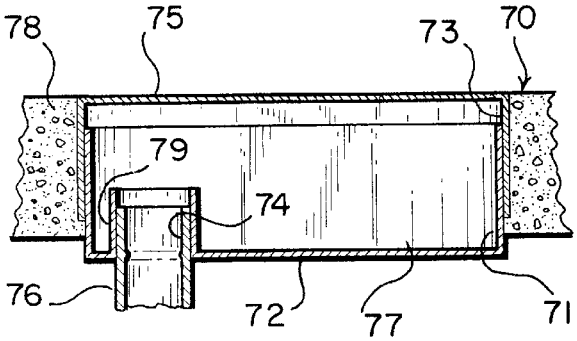
FIG 6A is a side view in cross-section of a plumbing system according to the present invention.

FIG. 6A shows a system 70 according to the present invention for use with the drain of a tub with a bowl 72 having a bore 74 through which projects a drain pipe 76 that extends below and away from a slab 78. A cap 73 initially covers the bowl 72. A top 75 of the cap 73 may be removed, punctured, or broken away to provide access to the bore 74.

A bottom 77 of the bowl 72 spaces apart an outer wall 71 and an inner wall 79. The inner wall 79 defines the bore 74.

In one particular embodiment of the present invention the bowl, cap, coupling and pipes are made of PVC material and are secured together with PVC cement. In one aspect the top of the cap is PVC about 1/16 inches thick. Such a cap top is easily cut and removed following slab set. In other embodiments, the cop or only the top thereof may be made of paper, cardboard, plastic, or metal foil.

When a bowl is used with inner and outer walls, these walls may be any desired height. The wall, may be even or uneven (as in FIGS. 1A, 3 and 5A), and the bowl may be any desired diameter. The bowl may be oval, circular, square, rectangular, triangular, or any suitable shape as viewed from above. As shown in FIG. 1H a single bowl may accommodate more than one pipe extending below and away from a slab.

The present invention, therefore, provides, in certain aspects, a bowl for a plumbing system, the bowl having an outer side wall, the outer side wall being generally cylindrical in shape with a hollow interior and having a height and a top opening; an inner wall, the inner wall being generally cylindrical and having a hollow interior, the inner wall having a top opening and a bottom opening and a height equal to or less than the height of the outer side wall; a bottom wall comprising a generally circular ring, the bottom wall having an outer edge contacting a lower edge of the outer side wall and an inner edge contacting a lower edge of the inner wall, the bottom wall spacing apart the outer side wall from the inner wall around a circumference of the bowl, and wherein the bottom opening of the inner wall is sized for receiving a pipe member, sewer pipe, drain pipe, etc.; such a bowl with a coupling member or sewer pipe, drain pipe, etc., positioned with a portion thereof within the bottom opening of the inner wall of the bowl; such a bowl wherein the coupling member is a hollow generally cylindrical coupling having a lower end suitable for receiving a top end of a drain pipe; any such bowl with a pipe member with an upper end and a lower end, the lower end positioned within a top end of the coupling member; any such bowl wherein the pipe member has a top end projecting upwardly beyond the top opening of the outer side wall, and, in one aspect, beyond a top edge of a cap member on the top of the bowl; any such bowl wherein concrete surrounds the bowl and has a top surface and the top end of the pipe member projects upwardly above the top surface of the concrete; any such bowl wherein the pipe member has a hollow interior and a lower first portion which is generally cylindrical and hollow, a second portion which is generally cylindrical and hollow and an upper third portion which is generally cylindrical and hollow, and the second portion is disposed between the first and third portions and at an angle to each of them, the angle such that a lower end of the lower first portion of the pipe member is rotatable within the bottom opening of the bowl as a part of the second portion of the pipe member rotates within the bowl providing a plurality of possible locations of a top end of the upper third portion; any such bowl wherein the top end of the upper third portion projects upwardly beyond the top opening of the outer side wall of the bowl; any such bowl wherein the pipe member has a hollow interior and a lower first portion which is generally cylindrical and hollow, and a second portion which is generally cylindrical and hollow, and the second portion is disposed at an angle to the lower first portion, the angle such that a lower end of the lower first portion of the pipe member is rotatable within the bottom opening of the bowl as a part of the second portion of the pipe member rotates within the bowl providing a plurality of possible locations of a top end of the second portion; and any such bowl with a cap over the top opening of the outer side wall; any such bowl wherein the cap is removably emplaced over the top opening of the outer side wall and/or wherein the cap has a tearable top portion removable from the cap to provide access to the interior of the bowl.

The present invention, therefore, provides, in certain embodiments methods for providing a pipe passageway through a concrete slab, the pipe passageway including a lower end thereof in fluid communication with a drain pipe beneath and extending away from the slab for draining fluid therethrough, the methods including positioning a bowl within a location of a slab to be poured and made of concrete, the bowl as any bowl described herein, pouring concrete around the bowl to form a slab, including pouring the concrete at least to a level such that concrete is level with a top of a cap of the bowl, and permitting the concrete to solidify to form the slab; any such method including removing the top of the cap and inserting a lower end of a pipe member into the coupling member; any such method wherein the pipe member has an angled portion above a portion whose lower end is received within a coupling member of the bowl and the method including rotating the lower end of the pipe member within the coupling member, thereby rotating the angled portion to locate a top of the angled portion at a desired location; any such method wherein the top end of the angled portion extends above a top surface of the slab; and any such method including sealingly securing the pipe member to the coupling.

The present invention, therefore, provides methods for forming a concrete slab, the methods including positioning a bowl within a location of a slab to be poured and made of concrete, the bowl as any described herein, pouring concrete around the bowl to form a slab, and permitting the concrete to solidify to form the slab; and such a method including removing a top of a cap of the bowl and inserting a lower end of a pipe member into the coupling member; wherein the pipe member has an angled portion above a portion whose lower end is received within the coupling member and the method further comprising rotating the lower end of the pipe member within the coupling member, thereby rotating the angled portion to locate a top of the angled portion at a desired location; wherein the top end of the angled portion extends above a top surface of the slab; and sealingly securing the pipe member to the coupling.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventor may rely on the Doctrine of Equivalents to determine and assess the scope of their invention and of the claims that follow as they may pertain to apparatus not materially departing from, but outside of, the literal scope of the invention as set forth in the following claims.

What is claimed is:

1. A bowl for a plumbing system, the bowl comprising an outer side wall, the outer side wall being generally cylindrical in shape with a hollow interior and having a height and a top opening, an inner wall, the inner wall being generally cylindrical and having a hollow interior, the inner wall having a top opening and a bottom opening and a height less than the height of the outer side wall, a bottom wall comprising a generally circular ring, the bottom wall having an outer edge contacting a lower edge of the outer side wall and an inner edge contacting a lower edge of the inner wall, the bottom wall spacing apart the outer side wall from the inner wall around a circumference of the bowl, and wherein the bottom opening of the inner wall is sized for receiving a pipe member, a coupling member positioned with a portion thereof within the bottom opening of the inner wall of the bowl, a pipe member with an upper end and a lower end, the lower end positioned within a top end of the coupling member, the pipe member having a hollow interior and a lower first portion which is generally cylindrical and hollow, a second portion which is generally cylindrical and hollow and an upper third portion which is generally cylindrical and hollow, and the second portion disposed between the first and third portions and at an angle to each of them, the angle such that a lower end of the lower first portion of the pipe member is rotatable within the bottom opening of the bowl as a part of the second portion of the pipe member rotates within the bowl providing a plurality of possible locations of a top end of the upper third portion.

2. The bowl of claim 1 further comprising a coupling member positioned with a portion thereof within the bottom opening of the inner wall of the bowl.

3. The bowl of claim 1 wherein the coupling member is a hollow generally cylindrical coupling having a lower end suitable for receiving a top end of a drain pipe.

4. The bowl of claim 1 wherein the coupling member is the top end of a sewer pipe.

5. The bowl of claim 1 wherein the pipe member has a top end projecting upwardly beyond the top opening of the outer side wall.

6. The bowl of claim 1 wherein concrete surrounds the bowl and has a top surface and the top end of the pipe member projects upwardly above the top surface of the concrete.

7. The bowl of claim 1 wherein the top end of the upper third portion projects upwardly beyond the top opening of the outer side wall of the bowl.

8. The bowl of claim 1 further comprising a cap over the top opening of the outer side wall.

9. The bowl of claim 8 wherein the cap is removably emplaced over the top opening of the outer side wall.

10. The bowl of claim 8 wherein the cap has a tearable top portion removable from the cap to provide access to the interior of the bowl.

11. A bowl for a plumbing system, the bowl comprising an outer side wall, the outer side wall being generally cylindrical in shape with a hollow interior and having a height and a top opening, an inner wall, the inner wall being generally cylindrical and having a hollow interior, the inner wall having a top opening and a bottom opening and a height less than the height of the outer side wall, a bottom wall comprising a generally circular ring, the bottom wall having an outer edge contacting a lower edge of the outer side wall and an inner edge contacting a lower edge of the inner wall, the bottom wall spacing apart the outer side wall from the inner wall around a circumference of the bowl, wherein the bottom opening of the inner wall is sized for receiving a pipe member, a pipe member with an upper end and a lower end, the lower end positioned within a top end of the coupling member, the pipe member having a hollow interior and a lower first portion which is generally cylindrical and hollow, and a second portion which is generally cylindrical and hollow, and the second portion disposed at an angle to the lower first portion, the angle such that a lower end of the lower first portion of the pipe member is rotatable within the bottom opening of the bowl as a part of the second portion of the pipe member rotates within the bowl providing a plurality of possible locations of a top end of the second portion.

12. The bowl of claim 11 further comprising a coupling member positioned with a portion thereof within the bottom opening of the inner wall of the bowl.

13. The bowl of claim 12 wherein the coupling member is a hollow generally cylindrical coupling having a lower end suitable for receiving a top end of a drain pipe.

14. The bowl of claim 12 wherein the coupling member is the top end of a sewer pipe.

15. The bowl of claim 12 wherein the pipe member has a top end projecting upwardly beyond the top opening of the outer side wall.

16. The bowl of claim 15 wherein concrete surrounds the bowl and has a top surface and the top end of the pipe member projects upwardly above the top surface of the concrete.

17. The bowl of claim 12 further comprising a cap over the top opening of the outer side wall.

18. The bowl of claim 17 wherein the cap is removably emplaced over the top opening of the outer side wall.

19. The bowl of claim 17 wherein the cap has a tearable top portion removable from the cap to provide access to the interior of the bowl.

* * * * *